United States Patent [19]

Yamamoto

[11] 4,168,006

[45] Sep. 18, 1979

[54] FOLDABLE SUPPORTER OF CLOTHES-DRYING BARS

[75] Inventor: Kazuyoshi Yamamoto, Osaka, Japan

[73] Assignee: Showa Sangyo Kabushiki Kaisha, Osaka, Japan

[21] Appl. No.: 915,508

[22] Filed: Jun. 14, 1978

[51] Int. Cl.[2] ..... A47F 5/00

[52] U.S. Cl. ..... 211/1.3; 211/1.5; 211/105; 248/277

[58] Field of Search ..... 211/1.3, 1.5, 105; 248/277, 324, 421

[56] References Cited

U.S. PATENT DOCUMENTS

| | | | |
|---|---|---|---|
| 1,092,496 | 4/1914 | Lockwood | 248/277 X |
| 1,135,637 | 4/1915 | Vogel | 211/1.3 X |
| 1,379,700 | 5/1921 | Scheu | 211/105 |
| 1,616,870 | 2/1927 | Rotthouse | 248/277 X |
| 1,627,559 | 5/1927 | Haul | 248/277 X |
| 2,237,141 | 4/1941 | Gale | 248/277 X |
| 2,560,466 | 7/1951 | Meinke | 248/277 X |
| 2,851,165 | 9/1958 | Schreyer et al. | 211/1.5 |
| 2,916,160 | 12/1959 | Cormier | 211/105 |

FOREIGN PATENT DOCUMENTS

| | | | |
|---|---|---|---|
| 357867 | 10/1931 | United Kingdom | 248/277 |
| 1044528 | 10/1966 | United Kingdom | 211/105 |
| 1444464 | 7/1976 | United Kingdom | 211/1.5 |

*Primary Examiner*—Thomas J. Holko

*Attorney, Agent, or Firm*—Eyre, Mann, Lucas & Just

[57] ABSTRACT

A foldable supporter of clothes-drying bars provided with an arrangement whereby the supporter can be withdrawn into its folded state to under the shelter of roof in response to the reception of rain drops on the rain-drop receiver, thereby avoiding the trouble that the drying clothes hung on the bars become wet in the rain.

2 Claims, 3 Drawing Figures

FOLDABLE SUPPORTER OF CLOTHES-DRYING BARS

This invention relates to a foldable supporter of clothes-drying bars, and more particularly, to an arrangement for incorporation in a foldable supporter of clothes-drying bars, whereby the foldable supporter is withdrawn in its folded state to under the shelter of roof when rain or snow begins to fall, thereby avoiding the trouble that the drying clothes become wet.

The foldable supporter of clothes-drying bars is known and in wide use, wherein the foldable supporter is composed of a series of linkages, each linkage being made up of four bars so arranged as to function as a pantograph. The foldable supporter is enlarged when its root portion is pushed by hand, and clothes-drying bar or bars are placed thereon for drying washed clothes. When the washed clothes become dry, the foldable supporter is reduced by pulling the handle, so as to draw the same to within the reach of the operator. In this way the conventional foldable supporter is enlarged or reduced by pushing or pulling the handle by hand. This is disadvantageous, especially when rain suddenly begins to fall, because it takes time before the housewife recognizes it. Particularly, the disadvantage is fatal when nobody stays at home who can take care of the drying washed clothes. In the rain the completely dried or half dried clothes will become wet.

The present invention aims at solving the problems encountered by the conventional foldable supporter of clothes-drying bars, and has for its object to provide an improved foldable supporter capable of withdrawing to under the shelter of roof in response to rain drops or snow flakes falling on the receiver, thereby preventing the rain or snow from wetting the clothes on the bars.

According to the present invention the foldable supporter of clothes-drying bars is made up of an appropriate number of links so arranged as to enlarge and reduce like a pantograph, and is provided with a spring at its root portion so as to enable the supporter to assume the withdrawn position by the tension of a spring. In addition, the foldable supporter is provided with a stop adapted to hold the same when the supporter is expanded against the spring, and the stop is provided with a trigger for relieving the supporter therefrom. The trigger is moved to come out of engagement with the stop, when rain drops are received on a receiver, thereby enabling the supporter to restore its original folded state under the pull of the spring. Thus, the foldable supporter as a whole takes shelter under the roof.

According to another aspect of the present invention the means for relieving the stop from the trigger includes a worm-gear and a pinion, wherein the worm-gear is mounted on the main shaft of a motor and wherein the pinion is mounted on the trigger, such that when the motor is driven to rotate the main shaft, the pinion is caused to roll on the worm, thereby enabling the trigger to shift to a place at which it stands out of engagement with the stop. Thus, when the stop releases the support the spring returns to its compressed state, thereby enabling the foldable supporter of clothes-drying bars to withdraw to under the shelter of roof.

According to a further aspect of the present invention the motor is electrically connected to a circuit including the rain-drop receiver and power source, such that when the receiver receives rain drops thereon, the circuit is electrically completed to drive the motor.

The present invention will be more particularly described by way of example with reference to the drawing, in which.

Figure 1:
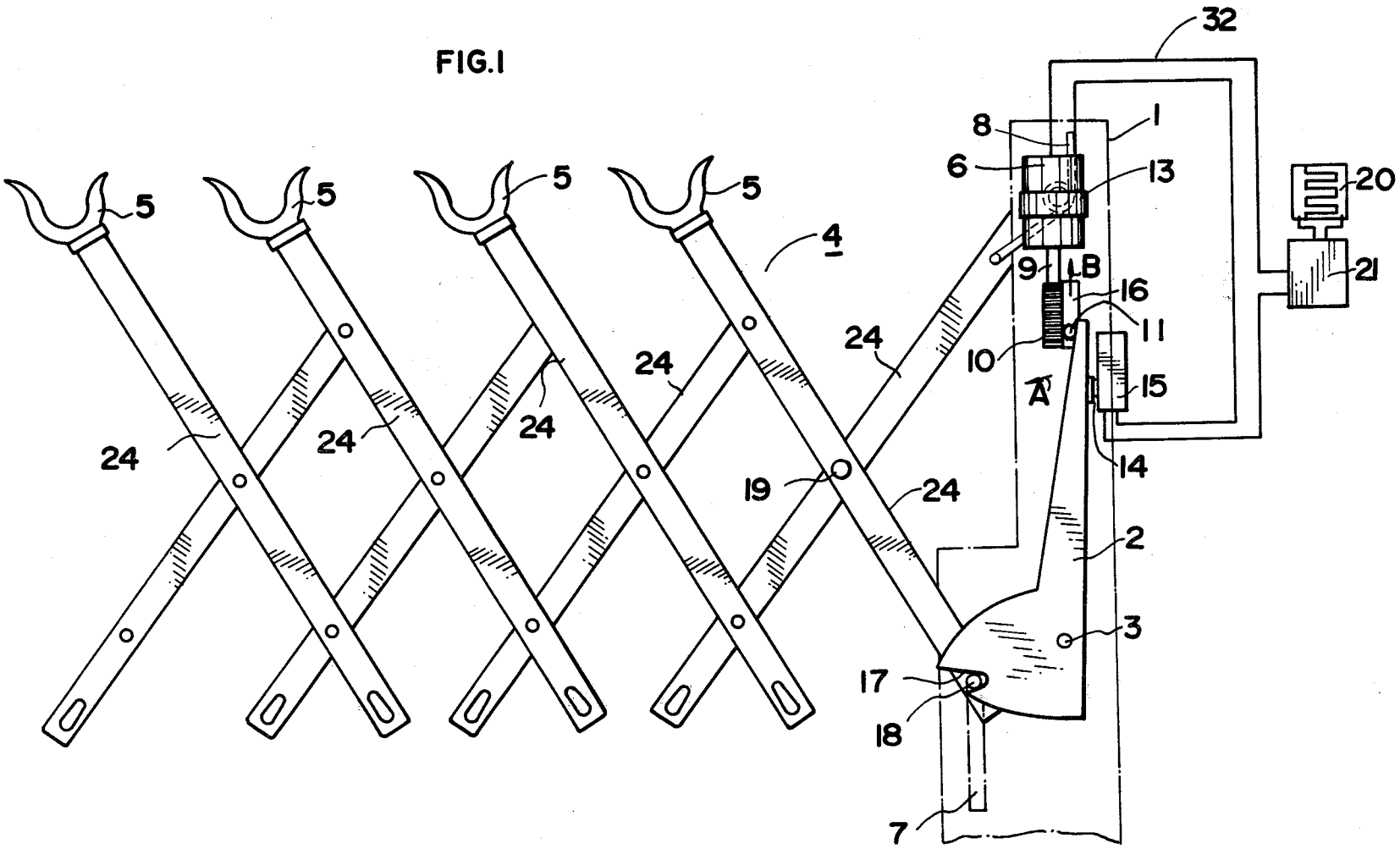
FIG. 1 is a schematic front view of the foldable supporter of clothes-drying bars and embodying the present invention.

As illustrated in FIG. 1, the foldable supporter 4 is made up of links 24 (in the illustrated embodiment a small number of links are shown for simplicity). The links are pivotally intersected with each other so as to move like a pantograph. The first links are supported in a channel-like bracket 1, wherein the upper link is pivoted to the bracket while the lower link is so arranged as to be slidable along one of the upright sides 1*a* and 1*b*. In the illustrated embodiment the lower link is provided with a pin 18 at its end while the upright side 1*b* of the bracket is provided with a slot 7 adapted to receive the pin 18, such that the pin moves up and down in accordance with the enlargement and reduction of the supporter 4. Two brackets 1 are mounted in pair on the house wall under the eaves of the roof, with the respective supporters 4 extendable in the same direction.

The reference numeral 19 indicates a handle bar by which the supporter is extended or retracted by hand. The supporter 4 is provided with forked members 5 adapted to receive clothes-drying bars 30. The forked member is made of plastic mouldings.

As described above, the upper link of the first linkage is pivoted in the bracket 1, and at the pivoted place a coiled spring 8 is fitted so as to pull the supporter 4 over to the side of the bracket in its folded state.

In the bracket 1 there is provided a stop 2 made of a metal plate, which is pivoted at 3 to the upright side 1*b* thereof. The stop 2 is pivoted thereto in its top-heavy state so as to rotate in the anti-clockwise direction when it has no support, and is additionally provided with a notch 17 for receiving the pin 18 so as to stop the supporter 4 from being folded under the urge of the coiled spring.

Figure 2:
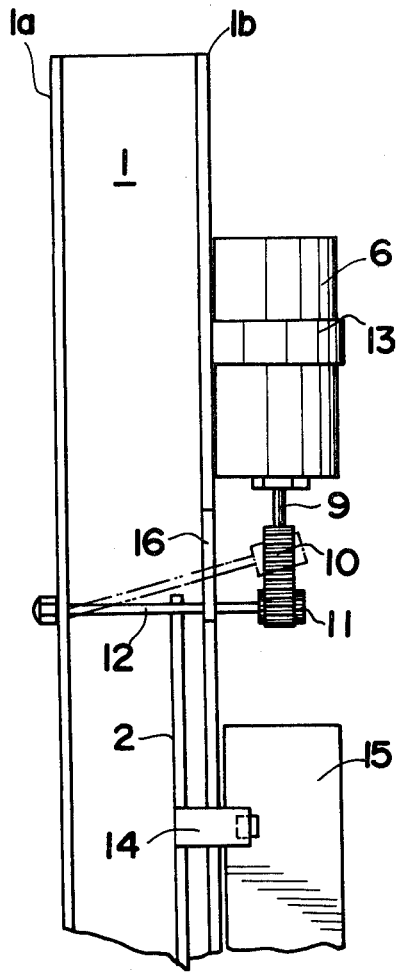
FIG. 2 is a side view on enlarged scale of the supporter shown in FIG. 1, partially being omitted.
Figure 3:
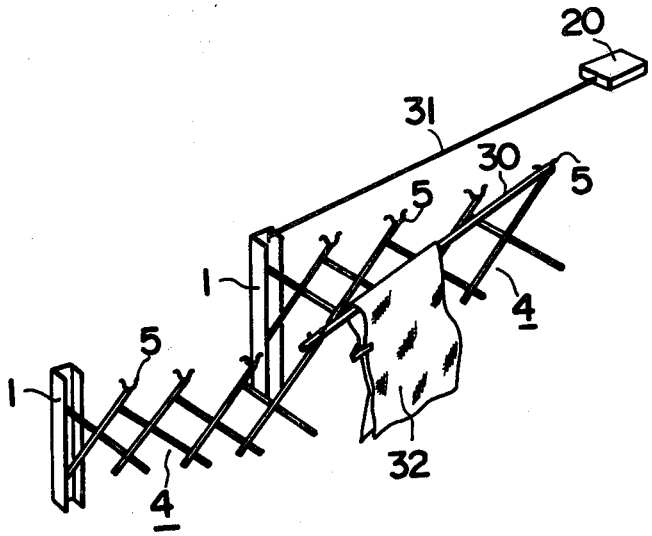
FIG. 3 is a perspective view in a schematic form of the foldable supporter in actual use.

The stop 2 is barred from its rotation by a trigger 12, which is supported by the upright sides 1*a* and 1*b* of the bracket as shown in FIG. 2. The upright side 1*b* of the bracket is provided with a slot 16 allowing the trigger 12 to move upwards in the direction indicated by the arrow B in FIG. 1. There is provided a motor 6 fastened to the outside surface of the upright side 1*b* by means of a band 13, and its main rotating shaft 9 is provided with a worm-gear 10, which is adapted to be in engagement with a pinion 11 mounted on the end of the trigger 12. The motor 6 is driven by power from a dry-cell box 21. Thus, when the motor 6 is driven and its rotating shaft 9 is rotated, the pinion 11 is caused to roll on the worm-gear, thereby enabling the trigger to move upwards coming out of engagement with the stop 2. As soon as the stop 2 is free from the trigger, it tends to rotate under the urge of its top-heavy structure, in the direction indicated by the arrow A. With no support by the stop 2 the pin 18 lowers in the slot 7. In this way the supporter 4 is folded into its original reduced state under the force of the coiled spring.

Adjacent to the stop 2 a limit switch 15 is provided for effecting the pre-set of the system. The stop 2 is provided with a pusher 14 whereby the limit switch is operated to pre-set the system ready for energizing the motor in response to the reception of rain-drops on a rain-drop receiver 20. The rain-drop receiver 20 is mounted on a pole 31 in a state at which the same is exposed to rain.

The motor 6, the limit switch 15, the dry-cell box 21 and the rain-drop receiver 20 are electrically connected to form the electric system or circuit 32.

In use a house-wife expands the foldable supporter 4 to its full length by pushing the handle 19 by hand, and place clothes-drying bars on the pair of supporters. Then the drying clothes 32 are hung on the bars. When the supporter is expanded, the circuit is preset. A shower begins to fall, and the receiver receives rain drops, and the circuit will be completed to energize the motor 6. When the main shaft 9 of the motor 6 is rotated, the pinion 11 is caused to roll on the worm-gear 10, thereby allowing the trigger 12 to be away from the stop 2. With no restraint by the trigger 12 the stop 2 tends to rotate in the anti-clockwise direction, thereby enabling the pin 18 of the lower link to lower in the slot 7. In this way the supporter is folded into its reduced state, which means that the drying clothes on the bars 30 are safely withdrawn to under the roof.

The pair of brackets 1 are electrically connected so as to share the same rain-drop receiver and the same source of power, thereby simplifying the structure as a whole.

For the motor 6 a miniature motor for toy locomotives and motorcars are employed, but instead of the motor the trigger 12 can be fastened to a retractile shaft of a solenoid such that the trigger is withdrawn together with the retractile shaft when the solenoid is energized in response to the reception of rain drops on the rain-drop receiver.

What I claim is:

1. A foldable supporter of clothes-drying bars, which comprises foldable links including members for receiving clothes-drying bars, a spring means for holding said foldable links in their folded state, a stop means for maintaining said foldable links in their expanded state against said spring means, a bracket supporting said foldable links, said bracket being adapted to be fastened to a house wall, said stop means being pivoted on said bracket in a top-heavy state so as to rotate when nothing supports the same, a trigger means adapted to bar said stop means from rotating under the urge of said top-heavy structure, said trigger means being provided with a pinion, a motor including a worm-gear mounted on its main rotating shaft, said pinion being in engagement with said worm-gear, a rain-drop receiver projecting outside the house roof, a source of power for driving said motor, said motor being mounted on said bracket adjacent to said stop means, a limit switch located sufficiently adjacent to said stop means such that the same is operated by said stop means when said stop means supports said foldable links in their expanded state, and an electric circuit including said said source of power, said rain-drop receiver, said limit switch and said motor.

2. A foldable supporter as claimed in claim 1, wherein the foldable links include a pin slidable in a slot produced in the bracket, and wherein the stop means includes a notch for receiving said pins so as to stop said pin from lowering in said slot when said stop means is held in its upright position by said trigger means.

* * * * *